US007695783B2

(12) United States Patent
Merkel et al.

(10) Patent No.: US 7,695,783 B2
(45) Date of Patent: Apr. 13, 2010

(54) IMAGE-RECORDING ELEMENT WITH FLUOROSURFACTANT AND COLLOIDAL PARTICLES

(75) Inventors: Paul B. Merkel, Victor, NY (US); Gary N. Barber, Penfield, NY (US); Alan R. Pitt, Sandridge (GB); Trevor J. Wear, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 267 days.

(21) Appl. No.: 10/622,421

(22) Filed: Jul. 18, 2003

(65) Prior Publication Data

US 2005/0013947 A1 Jan. 20, 2005

(51) Int. Cl.
*B41M 5/50* (2006.01)

(52) U.S. Cl. ..... 428/32.33; 428/32.26; 428/32.35

(58) Field of Classification Search ..... 428/32.26, 428/32.33

See application file for complete search history.

(56) References Cited

U.S. PATENT DOCUMENTS

| | | | | |
|---|---|---|---|---|
| 6,387,473 | B1 | 5/2002 | Sismondi et al. | |
| 6,495,242 | B1 * | 12/2002 | Tsuchiya et al. | 428/32.24 |
| 6,689,433 | B2 * | 2/2004 | Niu et al. | 428/32.38 |
| 6,919,109 | B2 * | 7/2005 | Nakano et al. | 428/32.26 |
| 2002/0076531 | A1 | 6/2002 | Ito et al. | |

FOREIGN PATENT DOCUMENTS

| | | |
|---|---|---|
| EP | 0 983 867 | 3/2000 |
| EP | 1 080 934 | 3/2001 |
| EP | 1 319 517 | 6/2003 |
| JP | 10-217599 | 8/1998 |
| JP | 2001-150805 | 6/2001 |
| JP | 2001-246838 | 9/2001 |
| WO | WO 01/96099 | 12/2001 |

* cited by examiner

*Primary Examiner*—Bruce H Hess
(74) *Attorney, Agent, or Firm*—Paul A. Leipold; Andrew J. Anderson

(57) ABSTRACT

The invention relates to an image-recording element comprising a support and an image-receiving layer, wherein the image-receiving layer comprises anionic colloidal silica particles, hydrophilic polymeric binder, and fluorosurfactant, wherein the binder is present in an amount of between 2% and 15% weight of the image-receiving layer, the image-recording element has a 60-degree gloss of greater than 25, and a dry time of less than 1 minute.

14 Claims, No Drawings

IMAGE-RECORDING ELEMENT WITH FLUOROSURFACTANT AND COLLOIDAL PARTICLES

FIELD OF THE INVENTION

The present invention relates to a porous inkjet recording element comprising anionic colloidal silica particles, hydrophilic polymeric binder, and fluorosurfactant, which has a glossy surface and is fast drying.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An inkjet recording element typically comprises a support having on at least one surface thereof an ink-receiving or image-receiving layer, and includes those intended for reflection viewing, which have an opaque support, and those intended for viewing by transmitted light, which have a transparent support.

It is well known that in order to achieve and maintain photographic-quality images on such an image-recording element, an inkjet recording element must:

- be readily wetted so there is no puddling, i.e., coalescence of adjacent ink dots, which leads to nonuniform density
- exhibit no image bleeding
- exhibit high gloss
- exhibit the ability to absorb high concentrations of ink and dry quickly to avoid elements blocking together when stacked against subsequent prints or other surfaces
- exhibit no discontinuities or defects due to interactions between the support and/or layer(s), such as cracking, repellencies, comb lines and the like
- not allow unabsorbed dyes to aggregate at the free surface causing dye crystallization, which results in bloom or bronzing effects in the image areas
- have an optimized image fastness to avoid fade from contact with water or radiation by daylight, tungsten light, or fluorescent light Inkjet recording elements known in the art include porous recording elements that have a porous image-receiving layer coated on one or both sides of a porous or nonporous support. The porous image-receiving layer can consist of a single or multiple layer coating. Typically, a porous image-receiving layer consists mostly of inorganic or organic particles and a small amount of binder such as a hydrophilic polymer. The particles are packed in the image-receiving layer and pores are formed between them. These pores must be sufficiently large and interconnected so that the recording liquid passes quickly through the layer and away from the outer surface to give the impression of fast drying.

While a wide variety of different types of porous recording elements for use with inkjet printing are known, there are many unsolved problems in the art and many deficiencies in the known products, which have severely limited their commercial usefulness. A major challenge in the design of a porous image-receiving layer is to be able to provide simultaneously an almost instantaneous ink dry time, high gloss and good image quality using inexpensive materials and manufacturing means.

U.S. Pat. No. 6,387,473 B1; U.S. Ser. No. 2002/0076531 A1; EP 1 080 934 A1; JP 02-956232 B2; and JP 10-217599 A relate to inkjet recording elements comprising particles, binder, and a fluorosurfactant. The problem with these recording elements is that they are nonporous and therefore dry very slowly when printed on with inkjet inks.

JP 2001-246838 A2 describes recording papers for inkjet printing which comprise inorganic fine particles and fluorine-containing amphoteric surfactants. The problem with these recording papers is that they are prepared using fumed inorganic oxides that are relatively expensive.

JP 2001-150805 A describes a method of manufacturing a recording material for inkjet printing in which the recording material comprises fumed inorganic oxide particles, binder and fluorosurfactant. The problem with this method is that the fumed inorganic oxide particles are relatively expensive, and costly manufacturing steps are needed to disperse the particles to a sub-micron particle size in order to prepare a useful coating.

PROBLEM TO BE SOLVED BY THE INVENTION

It is difficult to obtain a glossy, yet fast-drying, image-receiving layer with relatively monodispersed colloidal silica. As noted above, when a porous image-receiving layer is made with relatively monodispersed colloidal inorganic particles, such an image-receiving layer lacks the capacity to absorb a large quantity of ink because the nonporous colloidal particles pack tightly in the image-receiving layer and the porosity only comes from interstitial pores.

SUMMARY OF THE INVENTION

It is an object of this invention to provide a porous inkjet recording element that dries quickly and exhibits high gloss and good image quality. It is another object of this invention to provide a porous inkjet recording element that can be manufactured using inexpensive materials and manufacturing methods.

These and other objects are achieved in accordance with the present invention, which comprises an image-recording element comprising a support and an image-receiving layer, wherein the image-receiving layer comprises anionic colloidal silica particles, hydrophilic polymeric binder, and fluorosurfactant, wherein the binder is present in an amount of between 2% and 15% by weight of the image-receiving layer and the image-recording element has a 60-degree gloss of greater than 25 and a dry time of less than 1 minute.

ADVANTAGEOUS EFFECT OF THE INVENTION

The invention provides an improved, porous inkjet image-recording element for inkjet printing using aqueous-based inkjet ink compositions at ink laydowns typical of inkjet printers. The invention particularly provides a porous inkjet image-recording element that dries quickly after printing and provides photographic-quality images having high gloss and good image quality.

DETAILED DESCRIPTION OF THE INVENTION

When a porous image-receiving layer is made with relatively monodispersed colloidal inorganic particles, an image-receiving layer with relatively high gloss is produced. However, such an image-receiving layer lacks the capacity to absorb a large quantity of ink because the colloidal particles within the image-receiving layer are nonporous and pack tightly. The porosity only comes from interstitial pores, which are the spaces between the particles not filled by binder.

When a porous image-receiving layer is made with fumed inorganic particles, an image-receiving layer is produced which is fast-drying due to its high capacity to absorb a large quantity of ink. Although such fumed inorganic particles are nonporous, the image-receiving layer has high porosity because such particles are composed of large aggregates of small primary particles, which do not pack well. The poor packing of such aggregates in an image-receiving layer results in relatively large interstitial pores. However, the gloss of such image-receiving layers is usually low due to the size of the aggregates, which scatter light.

When a porous image-receiving layer is made with porous inorganic particles such as silica gel or precipitated silica, an image-receiving layer is produced which rapidly absorbs ink due its high capacity to absorb a large quantity of ink. The porosity of such image-receiving layer is high due to the internal pores of such porous particles and the interstitial pores between the particles. However, there is a disadvantage in that the gloss of such image-receiving layer is low due to the relatively large size of such porous inorganic particles, which scatter light.

Good image-receiving layer surface appearance is obtained when the surface is virtually crack-free and has high gloss. A crack-free surface appearance and high gloss can be obtained merely by adding more binder to the image-receiving layer. However, adding more binder increases ink dry time since the binder fills the pores in the image-receiving layer. Therefore, it is difficult to obtain an image-receiving layer which has a crack-free, glossy surface yet is fast drying.

In a preferred embodiment of the invention, the anionic colloidal silica particles are nonporous and have a median diameter of between 50 and 300 nm because this range provides an image-recording element having good performance in terms of dry time and gloss. It is more preferable that the anionic colloidal silica particles have a median diameter of between 80 and 200 nm because this range provides an image-recording element having excellent performance in terms of dry time and gloss. In a particularly preferred embodiment of the invention, the anionic colloidal silica particles are relatively monodispersed with at least 80% of the particles having a diameter of within 35% smaller or larger than the median diameter of the particles. Image-recording elements prepared with such monodispersed anionic colloidal silica particles have higher gloss, faster dry times, and better image quality than those elements prepared with more polydispersed anionic colloidal silica particles. Examples of commercially available colloidal silicas useful in the present invention include Nalco® 2329 from ONDEO Nalco Chemical Company and MP-1040, Snowtex® ZL, and Snowtex°YL from Nissan Chemical Industries.

The counterion of the anionic colloidal silica particles comprises sodium, potassium, or ammonium. In a preferred embodiment of the invention, the counterion is potassium because the gloss of an image-recording element prepared with anionic colloidal silica having potassium as the counterion usually is higher than if another counterion is used.

The image-receiving layer also contains a hydrophilic polymeric binder in an amount insufficient to substantially alter the porosity of the porous ink-receiving layer. In another preferred embodiment, the hydrophilic polymeric binder is a hydrophilic polymer such as poly(vinyl alcohol), gelatin, poly(vinylalcohol-co-ethyleneoxide), poly(vinyl pyrrolidone), cellulose ethers, poly(oxazolines), poly(vinylacetamides), partially hydrolyzed poly(vinylacetate/vinyl alcohol), poly(acrylic acid), poly(acrylamide), poly(alkylene oxide), sulfonated or phosphated polyesters and polystyrenes, casein, zein, albumin, chitan, chitosan, dextran, pectin, collagen derivatives, collodian, agar-agar, arrowroot, guar, carrageenan, tragacanth, xanthan, rhamsan and the like. In a preferred embodiment of the invention, the hydrophilic polymer is poly(vinyl alcohol), gelatin, or poly(vinylalcohol-co-ethyleneoxide). In still another preferred embodiment, the hydrophilic binder is poly(vinyl alcohol). In yet still another preferred embodiment, the hydrophilic binder is poly(vinyl alcohol) having a percent hydrolysis of 77 to 90. In yet still another embodiment, the hydrophilic binder is poly(vinyl alcohol) having a viscosity for a 4% aqueous solution at 20° C. of 2.5 to 12 cps. Image-recording elements prepared with poly(vinyl alcohol) having a percent hydrolysis of 77 to 90 and a viscosity for a 4% aqueous solution at 20° C. of 2.5 to 12 cps have faster dry times and better image quality than elements prepared with poly(vinyl alcohol) where these conditions are not met.

In accordance with the invention, the image-receiving layer also contains a fluorosurfactant. It is believed but not proven that certain fluorosurfactants are adsorbed to the surfaces of the anionic colloidal silica particles, causing the particles to agglomerate to a small extent. Use of these slightly agglomerated particles results in an image-receiving layer that has greater porosity while still retaining high gloss because the slightly agglomerated particles do not form a tight-packed structure and they are not large enough to scatter light.

While many fluorosurfactants are known in the art or are commercially available, many of the latter are proprietary so their chemical structures are not known or not fully disclosed. There are many different types of fluorosurfactants that can be used in the present invention but the ones that are preferred can be selected from those classified as nonionic, anionic, or amphoteric fluorosurfactants.

Examples of fluorosurfactants include, but are not limited to, surfactants having the tradenames Forafac® and Zonyl® (both from E. I. Du Pont de Nemours and Co.), Fluowet® (Clariant Corp.), Lodyne® (Ciba Specialty Chemicals) and Megaface® (Dainippon Ink & Chemicals, Inc.). In a preferred embodiment of the invention, the fluorosurfactant is Zonyl® FSO, Zonyl® FSN, Zonyl® FSH, or Zonyl® FS-300 which are nonionic linear perfluorinated polyethoxylated alcohols represented by the following formulas wherein x<y<z and x, y, and z are between 0 and 25 and wherein the distribution of the perfluoroethylene units in the perfluorinated portion of the four surfactants is different:

$$F-(CF_2CF_2)_{3\text{-}8}-CH_2CH_2O-(CH_2CH_2O)_x-H$$

Zonyl® FSO $$F-(CF_2CF_2)_{3\text{-}8}-CH_2CH_2O-(CH_2CH_2O)_y-H$$

Zonyl® FSN $$F-(CF_2CF_2)_{3\text{-}8}-CH_2CH_2O-(CH_2CH_2O)_x-H$$

Zonyl® FSH $$F-(CF_2CF_2)_{3\text{-}8}-CH_2CH_2O-(CH_2CH_2O)_z-H$$

Zonyl® FS-300

Image-recording elements prepared with these four Zonyl® fluorosurfactants have excellent performance in terms of dry time, gloss, and image quality.

Fluorosurfactants useful in the invention are oligomeric acrylamides having the structure shown in Formula I:

I

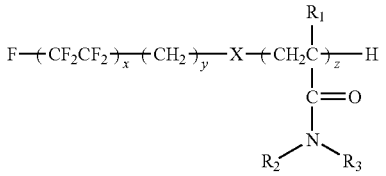

wherein x is 2 to 8;

y is 2 to 6;

z is 5 to 60;

X is S or

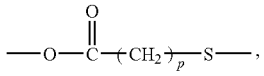

where p is 1 to 3;

R is H or $C_1$-$C_3$ alkyl;

$R_2$ and $R_3$ can be any of the following combinations:

$R_2$ and $R_3$ each independently represent an unsubstituted or substituted alkyl or aryl group, $R_2$ is H and $R_3$ is an isopropyl group, or $R_2$ and $R_3$, together with the adjacent N atom, form a heterocyclic ring.

In a preferred embodiment of the invention, x is 3 or 4;

y is 2 or 3;

z is 5 to 15;

X is S;

$R_1$ is H; and $R_2$ and $R_3$ can be any of the following combinations:

$R_2$ and $R_3$ each independently represent a methyl or ethyl group, or $R_2$ is H and $R_3$ is an isopropyl group.

Examples of preferred fluorosurfactants of Formula I are listed in Table I.

Especially preferred fluorosurfactants are F-1, F-2, and F-3 because image-recording elements prepared with these fluorosurfactants have excellent performance in terms of dry time, gloss, and image quality.

TABLE I

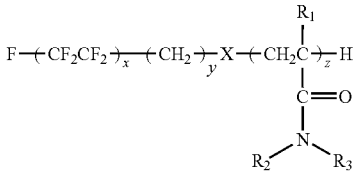

| Fluorosurfactant | x | y | z | X | $R_1$ | $R_2$ | $R_3$ |
|---|---|---|---|---|---|---|---|
| F-1 | 3 | 2 | 5 | S | H | $CH_3$ | $CH_3$ |
| F-2 | 3 | 2 | 10 | S | H | $CH_3$ | $CH_3$ |
| F-3 | 4 | 2 | 7 | S | H | $CH_3$ | $CH_3$ |
| F-4 | 4 | 2 | 15 | S | H | $CH_3$ | $CH_3$ |
| F-5 | 4 | 3 | 10 | S | $CH_3$ | $CH_3$ | $CH_3$ |
| F-6 | 3 | 3 | 10 | S | H | $CH_3$ | $CH_3$ |

TABLE I-continued

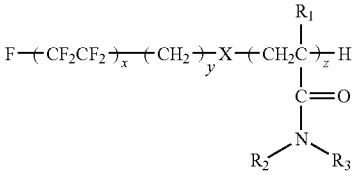

| Fluorosurfactant | x | y | z | X | $R_1$ | $R_2$ | $R_3$ |
|---|---|---|---|---|---|---|---|
| F-7 | 4 | 2 | 5 | S | $CH_3$ | $CH_2CH_3$ | $CH_2CH_3$ |
| F-8 | 3 | 2 | 15 | S | H | $CH_2CH_3$ | $CH_2CH_3$ |
| F-9 | 3 | 2 | 15 | S | H | H | $CH(CH_3)_2$ |
| F-10 | 4 | 2 | 20 | S | H | H | $CH(CH_3)_2$ |

Fluorosurfactants useful in the invention also include oligomeric ethylene oxides having the structure shown in Formula II:

II

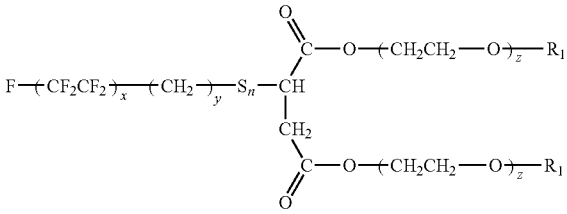

wherein x is 2 to 8;

y is 1 to 6;

z is 4 to 30;

n is 0 or 1;

$R_1$ is H, a methyl or an ethyl group.

In a preferred embodiment of the invention, x is 3 or 4;

y is 2 or 3;

z is 10 to 18;

n is 1; and $R_1$ is a methyl group.

Examples of preferred fluorosurfactants of Formula II are listed in Table II. Especially preferred fluorosurfactants are F-11 and F-12 because image-recording elements prepared with these fluorosurfactants have excellent performance in terms of dry time, gloss, and image quality.

TABLE II

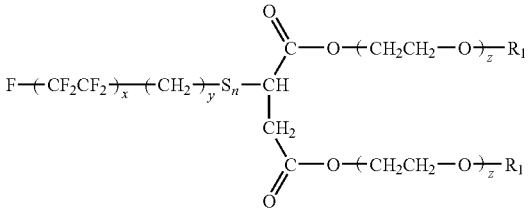

| Fluorosurfactant | x | y | z | n | $R_1$ |
|---|---|---|---|---|---|
| F-11 | 3 | 2 | 12 | 1 | $CH_3$ |
| F-12 | 4 | 2 | 16 | 1 | $CH_3$ |
| F-13 | 3 | 3 | 18 | 1 | $CH_3$ |
| F-14 | 4 | 3 | 10 | 1 | $CH_3$ |

Fluorosurfactants useful in the invention include oligomeric acrylamides having the structure shown in Formula III:

III

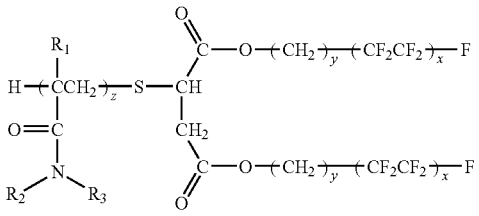

wherein x is 2 to 8;

y is 2 to 6;

z is 5 to60;

$R_1$ is H or $C_1$-$C_3$ alkyl; and $R_2$ and $R_3$ can be any of the following combinations:

$R_2$ and $R_3$ each independently represent an unsubstituted or substituted alkyl or aryl group, $R_2$ is H and $R_3$ is an isopropyl group, or $R_2$ and $R_3$, together with the adjacent N atom, form a heterocyclic ring.

In a preferred embodiment of the invention, x is 3 or 4;

y is 2 or 3;

z is 16 to 50;

$R_1$ is H or methyl; and $R_2$ and $R_3$ can be either of the following combinations:

$R_2$ and $R_3$ each independently represent a methyl or ethyl group, or $R_2$ is H and $R_3$ is an isopropyl group.

Examples of preferred fluorosurfactants of Formula III are listed in Table III. An especially preferred fluorosurfactant is F-15 because image-recording elements prepared with this fluorosurfactant have excellent performance in terms of dry time, gloss, and image quality.

TABLE III

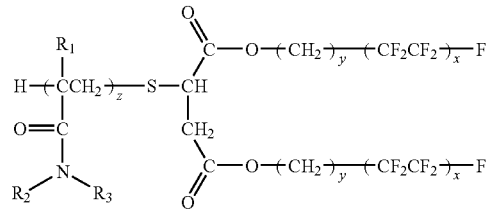

| Fluorosurfactant | x | y | z | $R_1$ | $R_2$ | $R_3$ |
|---|---|---|---|---|---|---|
| F-15 | 3 | 2 | 25 | H | $CH_3$ | $CH_3$ |
| F-16 | 3 | 2 | 50 | H | $CH_3$ | $CH_3$ |
| F-17 | 3 | 3 | 28 | H | $CH_3$ | $CH_3$ |
| F-18 | 4 | 2 | 20 | H | $CH_3$ | $CH_3$ |
| F-19 | 4 | 3 | 25 | H | $CH_3$ | $CH_3$ |
| F-20 | 4 | 2 | 16 | H | $CH_3$ | $CH_3$ |
| F-21 | 4 | 3 | 25 | $CH_3$ | $CH_3$ | $CH_3$ |
| F-22 | 4 | 2 | 25 | $CH_3$ | $CH_2CH_3$ | $CH_2CH_3$ |
| F-23 | 3 | 2 | 50 | H | $CH_2CH_3$ | $CH_2CH_3$ |
| F-24 | 4 | 2 | 25 | H | H | $CH(CH_3)_2$ |
| F-25 | 3 | 2 | 50 | H | H | $CH(CH_3)_2$ |

The fluorosurfactants of Formulas l-III may be prepared by well-known synthetic techniques, including those described in the examples below.

In a preferred embodiment of the invention, the fluorosurfactant is present in the image-receiving layer in an amount between 0.03% and 5% by weight of the image-receiving layer. When the fluorosurfactant is present in an amount less than 0.03% by weight of the image-receiving layer, the gloss of the image-receiving layer is less than desired and the dry time is longer than desired. When the fluorosurfactant is present is an amount greater than 5% by weight of the image-receiving layer, the dry time is longer than desired and some image quality attributes such as bleed and coalescence can be negatively impacted. In a more preferred embodiment, the fluorosurfactant comprises between 0.05% and 3% by weight of said image-receiving layer. Image-recording elements prepared with fluorosurfactants within this range have the best performance in terms of gloss, dry time, and image quality.

The fluorosurfactants of the invention are normally incorporated into the image-receiving layer by adding them as aqueous or alcoholic solutions to a coating composition of the anionic colloidal silica, hydrophilic binder, and other compatible materials, which may be added to enhance particular performance aspects dependent upon the end use. While the order of addition of the various components to the coating composition is not particularly important to obtain the advantages of the invention, it is somewhat preferred to add the fluorosurfactant to a coating composition comprising anionic colloidal silica and hydrophilic binder. Once the fluorosurfactant is added to the coating composition, it is important that the coating composition is applied to the surface of the support within a period of time not less than 2 minutes and not greater than 12 hours. If the fluorosurfactant-containing coating composition is applied to the surface of the support sooner than a 2-minute hold time or later than 12-hour hold time, the advantages of the invention may not be met. It is thought that a hold time shorter than 2 minutes does not allow sufficient time for the processes of fluorosurfactant adsorption to the surfaces of the anionic colloidal silica particles and subsequent agglomeration of such particles to occur, which results in low porosity. Furthermore, a hold time greater than 12 hours causes excessive agglomeration of such particles to occur, which results in low gloss. In a preferred embodiment of the invention, the coating composition is applied to the surface of the support within a time period not less than 5 minutes and not greater than 8 hours after the fluorosurfactant is added to the coating composition as this provides image-recording elements with the best gloss.

In another preferred embodiment of the invention, the image-receiving layer further comprises a latex polymer having a glass transition temperature of less than 30° C. Use of such latex polymer in the image-receiving layer reduces the occurrence of cracks that may arise during drying of the coating composition. Preferably the latex polymer is aqueous dispersible and is anionic or nonionic. Examples of such latex polymers include but are not limited to acrylate polymers such as: poly(n-butylacrylate-co-methacrylic acid) 95:5, poly (ethylacrylate-co-methacrylic acid) 95:5, poly(ethylene-co-n-butylacrylate-co-methacrylic acid) 60:35:5, poly(n-butylacrylate-co-2-acrylamido-2-methylpropane sulfonic acid sodium salt-co-2-acetoacetoxyethylmethacrylate 90:6:4, poly(n-butylacrylate-co-N-t-butylacrylamide) 60:40, and polyesters such as EASTMAN AQ® 29 (Eastman Chemical Company). The amount of latex polymer used should be high enough to prevent the occurrence of cracking, but low enough so that the interconnected pore structure formed by the agglomerated colloidal silica particles is not filled. In a further preferred embodiment of the invention, such latex polymer is present in the image-receiving layer in an amount of between 4% and 15% by weight of the image-receiving layer because this provides image-recording elements with the best coating quality without affecting dry time.

In still a further preferred embodiment of the invention, the image-receiving layer further comprises a hardener or crosslinker, which acts upon the preferred binders discussed above to impart mechanical durability to the image-receiving layer. Hardeners such as borax, boric acid and its salts, aldehydes, carbodiimides, polyfunctional aziridines, isocyanates, epoxides, polyvalent metal cations, and the like may be used. In a more preferred embodiment of the invention, the hardener comprises borax, boric acid and its salts, 1,4-dioxane-2, 3-diol, glyoxal, or bis(vinylsulfonyl)methane. Image-recording elements prepared with any of these hardeners have excellent performance in terms of dry time, gloss, and image quality.

Since the image-receiving layer is a porous layer comprising particles, the void volume must be sufficient to absorb all of the printing ink. In order to achieve the desired void volume, the total dry coverage of the image-receiving layer is between 35 to 65 g/m$^2$ if the image-receiving layer is coated on a nonporous support such as resin-coated paper. If the total coverage of the image-receiving layer is less than 35 g/m$^2$, the void volume is insufficient to absorb all of the printing ink, which leads to poor dry time and image quality defects such as coalescence and bleeding. If the total coverage of the image-receiving layer is greater than 65 g/m$^2$, the formation of cracks within the image-receiving layer becomes a concern.

The image-receiving layer may be coated on one or more ink-absorbing layers that are present between the image-receiving layer and a nonporous support. Since the one or more ink-absorbing layers present between the image-receiving layer and the support can absorb some of the printing ink, the total dry coverage of the image-receiving layer may be between 4 and 30 g/m$^2$ and preferably between 6 and 20 g/m$^2$ in order to obtain an inkjet recording element that has a glossy surface and is fast drying.

The image-receiving layer may be coated on a porous support such as paper. One or more ink-absorbing layers may be present between the image-receiving layer and the support. Since a porous support or the one or more ink-absorbing layers present between the image-receiving layer and the support can absorb some of the printing ink, the total dry coverage of the image-receiving layer may be between 4 and 30 g/m$^2$ and preferably between 6 and 20 g/m$^2$ in order to obtain an inkjet recording element that has a glossy surface and is fast drying.

As described above, the preferred inorganic particles of the invention comprise anionic colloidal silica. Dispersions of such anionic colloidal silica typically have a pH between 8 and 10 in order to maintain colloidal stability. Lowering the pH of such dispersions to less than 7.5 causes the particles to excessively agglomerate, while raising the pH to greater than 10.5 causes the particles to dissolve. In order to achieve the advantageous effects of the invention, the pH of the coating composition should be between 8 and 10. If it is necessary to raise the pH of the coating composition, an aqueous solution of an inorganic base may be used. Preferred inorganic bases are potassium hydroxide and ammonium hydroxide. In a preferred embodiment of the invention, the surface pH of a water-moistened image-receiving layer derived from such coating composition described above is between 8 and 10 because this provides image-recording elements with the best performance in terms of gloss, dry time, and image quality.

In addition to the image-receiving layer, the recording element may also contain a base layer next to the support, the function of which is to absorb the solvent from the ink. Materials useful for this layer include particles and polymeric binder. Examples of particles useful in the base layer include alumina, boehmite, clay, calcium carbonate, titanium dioxide, calcined clay, aluminosilicates, silica, barium sulfate, or polymeric beads. The particles may be porous or nonporous. In a preferred embodiment of the invention, the particles used in the base layer are metallic oxides such as alumina, boehmite, and silica.

In addition to the image-receiving layer, the recording element may also contain a layer on top of the image-receiving layer, the function of which is to enhance gloss. Materials useful for this layer include sub-micron particles and/or polymeric binder.

The support for the inkjet recording element used in the invention can be any of those usually used in the art, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (E. I. Du Pont de Nemours and Co.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The paper supports listed above include a broad range of papers, from high end papers, such as photographic paper to low end papers, such as newsprint. In a preferred embodiment, polyethylene-coated paper is employed. Polyethylene-coated paper is preferred because of its high smoothness and quality.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the image-receiving layer to the support, the surface of the support may be subjected to a corona-discharge treatment prior to applying the image-receiving layer. The adhesion of the image-receiving layer to the support may also be improved by coating a subbing layer on the support. Examples of materials useful in a subbing layer include halogenated phenols and partially hydrolyzed vinyl chloride-co-vinyl acetate polymer.

The coating composition is coated from water or a mixture of water and organic solvents; however, water alone is preferred. The total solids content should be selected to yield a useful coating thickness in the most economical way, and for particulate coating compositions, solids contents from 10-40 wt. % are typical.

Coating compositions employed in the invention may be applied by any number of well-known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure No. 308119, published Dec. 1989, pages 1007 to 1008. Slide coating, in which the base layers and overcoat may be simultaneously applied, is preferred. Slide coating is preferred because very high quality coatings may be obtained at a low cost using this coating method. After coating, the layers are generally dried by simple evaporation, which may be accelerated by known techniques such as convection heating.

The coating composition may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

After coating, the inkjet recording element may be subject to calendering or supercalendering to enhance surface smoothness. In a preferred embodiment of the invention, the inkjet recording element is subject to hot soft-nip calendering at a temperature of about 65° C. and a pressure of 14000 kg/m at a speed of from about 0.15 m/s to about 0.3 m/s.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additional surfactants, defoamers or the like may be added as long as they do not interfere with the interactions between the fluorosurfactant and colloidal particles. A common level for these coating aids is 0.01% to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir. While image-recording elements of the invention find their primary use in the inkjet art, they also would be useful for other imaging techniques. They could be used for electrophotography, thermal imaging, lithography or flexography.

The following examples illustrate the practice of this invention. They are not intended to be exhaustive of all possible variations of the invention. Parts and percentages are by weight unless otherwise indicated.

EXAMPLES

Synthesis of Fluorosurfactant F-1 Employed in the Invention 1H, 1H,2H,2H-Perfluorooctanethiol (Foralkyl® EM-6) (Elf Atochem) (7.61 g, 0.02 mole) and N,N-dimethylacrylamide (Aldrich) (10.00 g, 0.10 mole) were dissolved in methanol (100 ml) and degassed with argon for 20 minutes. 2,2'-Azobis(2-methylpropionitrile) (Acros Organics) (0.20 g) was added and the solution stirred and heated to reflux under argon for 7 hours. The solution was cooled and then evaporated to give a clear viscous oil (17.6 g, 100% yield). Analysis was consistent with the compound F-1.

Synthesis of Fluorosurfactant F-11 Employed in the Invention

Poly(ethylene glycol methyl ether) (average $M_n$ ca. 550) (Aldrich) (110.0 g, 0.20 mole) and maleic anhydride (Aldrich) (9.81 g, 0.10 mole) were refluxed in toluene (200 ml) in the presence of a catalytic amount of concentrated sulfuric acid (0.1 ml) for a period of 18 hours. The crude solution was treated with sodium hydrogen carbonate (5.0 g, solid) and then diluted with ethyl acetate (800 ml). A small quantity of water was added to ensure that the sodium hydrogen carbonate reacted with any residual acid. Then the solution was dried over magnesium sulfate, filtered and evaporated at reduced pressure to give the poly(ethylene glycol) methyl ether diester of maleic acid as an off-white semi-solid (105.9 g, 88% yield).

1H,1H,2H,2H-Perfluorooctanethiol (Foralkyl® EM-6) (19.10 g, 0.050 mol) and the poly(ethylene glycol) methyl ether diester of maleic acid (60.10 g, 0.050 mol) were heated together with stirring at 130° C. under an argon atmosphere in the presence of a catalytic amount of anhydrous potassium carbonate for a period of 4 hours. During this time the solution went from colorless to reddish brown. The crude product was dissolved in ethyl acetate and chromatographed on silica gel (63-200 mesh) eluting with ethyl acetate and ethanol mixtures to give, after concentration under reduced pressure, a pale yellow, viscous oil (48.7 g, 62% yield). Analytical data were consistent with the structure F-11.

Synthesis of Fluorosurfactant F-15 Employed in the Invention

Mercaptosuccinic acid (Aldrich) (12.5 g, 0.083 mole) and 1H,1H,2H,2H-perfluorooctan-1-ol (Fluorochem Ltd.) (60.6 g, 0.166 mole) were suspended in toluene (400 ml). p-Toluene sulfonic acid hydrate (Aldrich) (0.36 g) was added and the mixture refluxed under argon atmosphere for 72 hours in a flask equipped with a Dean & Stark reflux condenser. The solution was allowed to cool and the toluene was removed by evaporation under reduced pressure. The resulting oil was redissolved in ethyl acetate (1000 ml) and washed with saturated aqueous sodium hydrogen carbonate (800 ml). The organic layer was separated, dried over anhydrous magnesium sulfate, filtered and evaporated to give 2-mercaptosuccinic acid bis-(3,3,4,4,5,5,6,6,7,7,8,8,8-tridecafluorooctyl) ester as a pale yellow oil (66.2 g, 100% yield).

N,N-Dimethylacrylamide (25.0 g, 0.25 mole), 2-mercaptosuccinic acid bis-(3,3,4,4,5,5,6,6,7,7,8,8,8-tridecafluorooctyl) ester (8.42 g, 0.010 mole) and 2,2'-azobis(2-methylpropionitrile) (0.35 g) were stirred in methanol (250 ml) and degassed by bubbling argon through the solution for 20 minutes. The solution was then refluxed under argon atmosphere for 17 hours. The reaction mixture was evaporated to give a colorless solid (56.3 g). The solid was redissolved in water and freeze-dried to give a white solid (33.1 g, 99% yield). Analytical data were consistent with the structure F-15.

Measurement of Silica Particle Size and Distribution

The volume-weighted median particle size and particle size distribution of the silica samples were measured by a dynamic light scattering method using a MICROTRAC® Ultrafine Particle Analyzer (UPA) Model 150 from Leeds & Northrop. The analysis provides percentile data that show the percentage of the volume of the particles that is smaller than the indicated size. The 50 percentile is known as the median diameter. One measure of particle size distribution is the difference between the 10 percentile and the 90 percentile, which defines a volume-weighted range in which 80% of the particles fall. This volume-weighted range is referred herein as the particle size range.

Example 1

Element 1 of the Invention

A common solution was prepared by mixing 112.5 g of 20.0% Airvol® 203 poly(vinyl alcohol) (Air Products), 287.6 g of water, 477.4 g of a 41.0% dispersion of anionic colloidal silica particles (Nalco® TX-11005 lot XC2D0547 from ONDEO Nalco Chemical Company) with a median diameter of 123 nm and a particle size range of 46 nm (80% of the silica particles have a diameter of within 19% smaller or larger than the median diameter), and 22.5 g of the hardener 1,4-dioxane-2,3-diol to provide a solution of 25% solids by weight. A 25.0 g aliquot of this common solution was withdrawn and stirred and then 0.94 g of a 10% solution of the fluorosurfactant Zonyl® FSN was added to provide an aqueous coating composition with a colloidal silica/poly(vinyl alcohol)/hardener/fluorosurfactant weight ratio of 87/10/2/1. This coating solution was stirred at ambient temperature for 10 minutes. A polyethylene-coated paper base, which had been previously subjected to corona discharge treatment, was placed on top of a coating block heated at 40° C. A layer of the coating composition was coated on the resin-coated paper base using a coating blade with a spacing gap of 254 μm. The coating was then left on the coating block until dry to yield a recording element in which the thickness of the image-receiving layer was about 39 μm and the coverage was about 53 g/m$^2$.

Elements 2-13 of the Invention

These elements were prepared the same as Element 1 except that Zonyl® FSN was replaced by each of the fluorosurfactants in the amounts as shown in Table IV.

Comparative Element 1

This element was prepared the same as Element 1 except that Zonyl® FSK (E. I. Du Pont de Nemours and Co.), an amphoteric fluorosurfactant, was used instead of Zonyl® FSN.

Comparative Element 2

This element was prepared the same as Element 1 except that Fluowet® NMQ (Clariant Corp.), a cationic fluorosurfactant, was used instead of Zonyl® FSN.

Comparative Element 3

This element was prepared the same as Element 1 except that Lodyne® S-222N (Ciba Specialty Chemicals), a nonionic fluorosurfactant, was used instead of Zonyl® FSN.

Comparative Element 4

This element was prepared the same as Element 1 except that Forafac® 1210 (E. I. Du Pont de Nemours and Co.), a nonionic fluorosurfactant, was used instead of Zonyl® FSN.

Comparative Element 5

This element was prepared the same as Element 1 except that Lodyne® S-107B (Ciba Specialty Chemicals), a nonionic fluorosurfactant, was used instead of Zonyl® FSN.

Comparative Element 6

This element was prepared the same as Element 1 except that Lodyne® S-103A (Ciba Specialty Chemicals), an anionic fluorosurfactant, was used instead of Zonyl® FSN.

Comparative Element 7

This element was prepared the same as Element 1 except that Zonyl® FS-62 (E. I. Du Pont de Nemours and Co.) was used instead of Zonyl® FSN.

TABLE IV

| Element | Surfactant | Amount (wt. %) |
|---|---|---|
| 1 | Zonyl ® FSN | 1.0 |
| 2 | Zonyl ® FSH | 1.0 |
| 3 | Zonyl ® FSO | 1.0 |
| 4 | Zonyl ® FS-300 | 1.0 |
| 5 | Lodyne ® S-100 | 1.0 |
| 6 | Fluowet ® OTN | 3.0 |
| 7 | Zonyl ® FSE | 3.0 |
| 8 | Forafac ® 1157 | 1.0 |
| 9 | Megaface ® F-443 | 3.0 |
| 10 | Megaface ® F-1405 | 3.0 |
| 11 | F-1 | 1.0 |
| 12 | F-11 | 1.0 |
| 13 | F-15 | 1.0 |
| Comparative 1 | Zonyl ® FSK | 1.0 |
| Comparative 2 | Fluowet ® NMQ | 1.0 |
| Comparative 3 | Lodyne ® S-222N | 1.0 |
| Comparative 4 | Forafac ® 1210 | 1.0 |
| Comparative 5 | Lodyne ® S-107B | 1.0 |
| Comparative 6 | Lodyne ® S-103A | 1.0 |
| Comparative 7 | Zonyl ® FS-62 | 1.0 |

Gloss

The dried coatings were measured for 60° specular glossiness using a BYK-Gardner® micro-TRI-gloss meter. A gloss measurement of at least about 25% is desirable.

Dry Time

An ink formulation of Direct Yellow 132 (Avecia ProJet® 1G) was prepared according to the formulation described in Table V.

TABLE V

| Component | Amount (wt. %) |
|---|---|
| Direct Yellow 132 | 3.8% |
| Glycerol | 15.5% |
| Diethylene glycol | 3.0% |
| Triethylene glycol monobutyl ether | 9.0% |
| Triethanolamine | 0.9% |
| Lactic acid | 0.24% |
| Water | 67.56% |

A series of individual ink drops was rapidly delivered to each of the elements described above using a 2 μL Drummond MICROCAPS™ disposable micropipet containing the yellow ink formulation described above. Each ink drop delivered about 32 g/m$^2$ of ink as determined by drop weight and drop area measurements. At 5-second intervals, an ink spot was swiped with a finger until all of the ink spots were swiped. If an ink spot was not completely dry, ink smearing occurred. After the last ink spot was swiped, each ink spot starting with the first ink spot made was viewed with an illuminated microscope at 70× magnification. The length of time from ink delivery to swiping for the first ink spot that showed no evidence of ink smearing is defined as the dry time for that element.

Image Quality

Test images specifically designed to evaluate coalescence and bleed were printed on each of the elements using an Epson Stylus® Photo 870 inkjet printer using inks with catalogue numbers CT13T007201 and C13T008201. The image quality of the printed images was evaluated subjectively. Coalescence refers to the nonuniformity or puddling of the ink in solid filled areas. Bleeding refers to the ink flowing out of its intended boundaries.

Coating Quality

The dried coatings were visually evaluated for cracking defects. The following results were obtained:

TABLE VI

| Element | 60° Gloss (%) | Dry Time (sec.) | Coalescence | Bleed | Coating Quality |
|---|---|---|---|---|---|
| 1 | 50 | 20 | Good | Good | Good |
| 2 | 43 | 20 | Good | Good | Good |
| 3 | 40 | 25 | Good | Good | Good |
| 4 | 46 | 25 | Good | Good | Good |
| 5 | 38 | 25 | Good | Good | Good |
| 6 | 29 | 25 | Good | Good | Good |
| 7 | 31 | 30 | Good | Fair | Good |
| 8 | 37 | 35 | Good | Good | Good |
| 9 | 51 | 40 | Good | Good | Good |
| 10 | 40 | 25 | Good | Good | Good |
| 11 | 37 | 50 | Good | Good | Good |
| 12 | 43 | 20 | Good | Good | Good |
| 13 | 34 | 15 | Good | Good | Good |
| Comparative 1 | 2 | 30 | Fair | Fair | Good |
| Comparative 2 | 44 | N/A | N/A | N/A | Poor |
| Comparative 3 | 9 | 25 | Good | Good | Good |
| Comparative 4 | 42 | 60 | Poor | Poor | Good |
| Comparative 5 | 4 | 20 | Good | Good | Good |
| Comparative 6 | 2 | 15 | Good | Fair | Fair |
| Comparative 7 | 3 | 15 | Good | Fair | Fair |

N/A means not available; the coating quality of this element was so poor that it was not printed.

The above results show that high gloss, fast dry time, and good image quality are observed with the recording elements of the invention as compared to the comparative recording elements.

Example 2

Element 14 of the Invention

A coating solution was prepared by mixing 15.99 g of a 41.0% dispersion of anionic colloidal silica particles (Nalco® TX-11005 lot XC2D0547 from ONDEO Nalco Chemical Company) with a median diameter of 123 nm and a particle size range of 46 nm (80% of the silica particles have a diameter of within 19% smaller or larger than the median diameter), 8.38 g of water, 3.75 g of 20.0% Airvol® 203 poly(vinyl alcohol), 0.75 g of the hardener 1,4-dioxane-2,3-diol, and 1.13 g of a 10% solution of the fluorosurfactant Zonyl® FSN to provide a 30.0 g of coating solution of 25% solids by weight. The colloidal silica/poly(vinyl alcohol)/hardener/fluorosurfactant weight ratio was 87/10/2/1.5. After the fluorosurfactant was added, the coating solution was stirred at ambient temperature for 10 minutes and then applied to a polyethylene-coated paper base as described above in Example 1 to yield a recording element in which the thickness of the image-receiving layer was about 43 μm and the coverage was about 56 g/m$^2$.

Element 15 of the Invention

This element was prepared the same as Element 14 except that the anionic colloidal silica dispersion Nalco® TX-11005 lot XC2D0547 was replaced by the anionic colloidal silica dispersion Nalco® TX-11005 lot XC1K0153 (ONDEO Nalco Chemical Company) with a median diameter of 162 nm and a particle size range of 97 nm (80% of the silica particles have a diameter of within 30% smaller or larger than the median diameter) as shown in Table VII.

Element 16 of the Invention

This element was prepared the same as Element 14 except that the anionic colloidal silica dispersion Nalco® TX-11005 lot XC2D0547 was replaced by the anionic colloidal silica dispersion Nalco® 2329 (ONDEO Nalco Chemical Company) with a median diameter of 98 nm and a particle size range of 54 nm (80% of the silica particles have a diameter of within 27% smaller or larger than the median diameter) as shown in Table VII.

Element 17 of the Invention

This element was prepared the same as Element 14 except that the anionic colloidal silica dispersion Nalco® TX-11005 lot XC2D0547 was replaced by the anionic colloidal silica dispersion MP 1040 (Nissan Chemical Industries, LTD.) with a median diameter of 125 nm and a particle size range of 52 nm (80% of the silica particles have a diameter of within 21% smaller or larger than the median diameter) as shown in Table VII.

Element 18 of the Invention

This element was prepared the same as Element 14 except that the anionic colloidal silica dispersion Nalco® TX-11005 lot XC2D0547 was replaced by the anionic colloidal silica dispersion Snowtex® ZL (Nissan Chemical Industries, LTD.) with a median diameter of 123 nm and a particle size range of 63 nm (80% of the silica particles have a diameter of within 25% smaller or larger than the median diameter) as shown in Table VII.

Element 19 of the Invention

This element was prepared the same as Element 14 except that the anionic colloidal silica dispersion Nalco® TX-11005 lot XC2D0547 was replaced by the anionic colloidal silica dispersion Snowtex® YL (Nissan Chemical Industries, LTD.) with a median diameter of 94 nm and a particle size range of 63 run (80% of the silica particles have a diameter of within 34% smaller or larger than the median diameter) as shown in Table VII.

Element 20 of the Invention

This element was prepared the same as Element 14 except that the anionic colloidal silica dispersion Nalco® TX-11005 lot XC2D0547 was replaced by the anionic colloidal silica dispersion EF20910 (Eka Chemicals) with a median diameter of 208 nm and a particle size range of 124 nm (80% of the silica particles have a diameter of within 30% smaller or larger than the median diameter) as shown in Table VII.

Comparative Element 8

This element was prepared the same as Element 14 except that the anionic colloidal silica dispersion Nalco® TX-11005 lot XC2D0547 was replaced by the anionic colloidal silica dispersion Nyacol® IJ200 (Eka Chemicals) with a median diameter of 59 nm and a particle size range of 141 nm (80% of the silica particles have a diameter of within 119% smaller or larger than the median diameter) as shown in Table VII.

Comparative Element 9

This element was prepared the same as Element 14 except that the anionic colloidal silica dispersion Nalco® TX-11005 lot XC2D0547 was replaced by the anionic colloidal silica dispersion Snowtex® XL (Nissan Chemical Industries, LTD.) with a median diameter of 66 nm and a particle size range of 54 nm (80% of the silica particles have a diameter of within 41% smaller or larger than the median diameter) as shown in Table VII.

Comparative Element 10

This element was prepared the same as Element 14 except that the anionic colloidal silica dispersion Nalco® TX-11005 lot XC2D0547 was replaced by the anionic colloidal silica dispersion Nalco® 1060 (ONDEO Nalco Chemical Company) with a median diameter of 78 nm and a particle size range of 69 nm (80% of the silica particles have a diameter of within 44% smaller or larger than the median diameter) as shown in Table VII.

Comparative Element 11

This element was prepared the same as Element 14 except that the anionic colloidal silica dispersion Nalco® TX-11005 lot XC2D0547 was replaced by the anionic colloidal silica dispersion Nalco® TX-11005 lot XCOK1239 (ONDEO Nalco Chemical Company) with a median diameter of 44 nm and a particle size range of 28 nm (80% of the silica particles have a diameter of within 32% smaller or larger than the median diameter) as shown in Table VII.

Comparative Element 12

This element was prepared the same as Element 14 except that the anionic colloidal silica dispersion Nalco® TX-11005 lot XC2D0547 was replaced by the anionic colloidal silica dispersion Ludox® TM-50 (E. I. Du Pont de Nemours and Co.) with a median diameter of 9 nm and a particle size range of 6 nm (80% of the silica particles have a diameter of within 31% smaller or larger than the median diameter) as shown in Table VII.

TABLE VII

| Element | Silica Dispersion (Counterion) | Particle Median Size (nm) | Particle Size Range (nm) |
|---|---|---|---|
| 14 | Nalco ® TX-11005 lot XC2D0547 ($K^+$) | 123 | 46 |
| 15 | Nalco ® TX-11005 lot XC1K0153 ($K^+$) | 162 | 97 |
| 16 | Nalco ® 2329 ($Na^+$) | 98 | 54 |
| 17 | MP-1040 ($Na^+$) | 125 | 52 |
| 18 | Snowtex ® ZL ($Na^+$) | 123 | 63 |
| 19 | Snowtex ® YL ($Na^+$) | 94 | 64 |
| 20 | EF20910 ($Na^+$) | 208 | 124 |
| Comparative 8 | Nyacol ® IJ200 ($Na^+$) | 59 | 141 |
| Comparative 9 | Snowtex ® XL ($Na^+$) | 66 | 54 |
| Comparative 10 | Nalco ® 1060 ($Na^+$) | 78 | 68 |
| Comparative 11 | Nalco ® TX-11005 lot XCOK1239 | 44 | 28 |
| Comparative 12 | Ludox ® TM-50 ($Na^+$) | 9 | 6 |

N/A means not available; the coating quality of this element was so poor that it was not printed.

The above elements were evaluated for 60° gloss, dry time, image quality, and coating quality as described in Example 1. The following results were obtained:

TABLE VIII

| Element | 60° Gloss (%) | Dry Time (sec.) | Coalescence | Bleed | Coating Quality |
|---|---|---|---|---|---|
| 14 | 51 | 20 | Good | Good | Good |
| 15 | 46 | 15 | Good | Good | Good |
| 16 | 46 | 25 | Good | Good | Good |
| 17 | 36 | 10 | Good | Good | Good |

TABLE VIII-continued

| Element | 60° Gloss (%) | Dry Time (sec.) | Coalescence | Bleed | Coating Quality |
|---|---|---|---|---|---|
| 18 | 41 | 20 | Good | Good | Good |
| 19 | 36 | 25 | Good | Good | Good |
| 20 | 45 | 20 | Good | Good | Good |
| Comparative 8 | 18 | N/A | N/A | N/A | Poor |
| Comparative 9 | 12 | 20 | Good | Good | Good |
| Comparative 10 | 3 | 5 | Fair | Good | Good |
| Comparative 11 | 54 | 30 | Fair | Fair | Fair |
| Comparative 12 | 3 | 5 | Fair | Good | Poor |

N/A means not available; the coating quality of this element was so poor that it was not printed.

The above results show that high gloss, fast dry time, and good image quality are observed with the recording elements of the invention as compared to the comparative recording elements.

Example 3

Elements 21 of the Invention

This element was prepared in a similar manner to that of Element 14 in Example 2.

Element 22 of the Invention

This element was prepared the same as Element 21 except that Airvol® was replaced by the poly(vinyl alcohol) Celvol® 502 (Celanese Chemicals) as shown in Table IX.

Element 23 of the Invention

This element was prepared the same as Element 21 except that Airvol® 203 was replaced by the poly(vinyl alcohol) GL-05 (Nippon Gohsei) as shown in Table IX.

Element 24 of the Invention

This element was prepared the same as Element 21 except that Airvol® 203 was replaced by the poly(vinyl alcohol) KL-05 (Nippon Gohsei) as shown in Table IX.

Comparative Element 13

This element was prepared the same as Element 21 except that the poly(vinyl alcohol) GM-14L (Nippon Gohsei) was used instead of Airvol® 203.

Comparative Element 14

This element was prepared the same as Element 21 except that the poly(vinyl alcohol) GH-17 (Nippon Gohsei) was used instead of Airvol® 203.

Comparative Element 15

This element was prepared the same as Element 21 except that the poly(vinyl alcohol) KP-06 (Nippon Gohsei) was used instead of Airvol® 203.

Comparative Element 16

This element was prepared the same as Element 21 except that the poly(vinyl alcohol) AL-06 (Nippon Gohsei) was used instead of Airvol® 203.

Comparative Element 17

This element was prepared the same as Element 21 except that the poly(vinyl alcohol) NL-05 (Nippon Gohsei) was used instead of Airvol® 203.

TABLE IX

| Element | Poly(vinyl alcohol) | Percent Hydrolysis | Viscosity (cps)* |
|---|---|---|---|
| 21 | Airvol ® 203 | 87.0-89.0 | 3.5-4.5 |
| 22 | Celvol ® 502 | 87.0-89.0 | 3.0-3.7 |
| 23 | GL-05 | 86.5-89.0 | 4.8-5.8 |
| 24 | KL-05 | 78.5-82.0 | 4-5 |
| Comparative 13 | GM-14L | 86.5-89.0 | 16-20 |
| Comparative 14 | GH-17 | 86.5-89.0 | 27-33 |
| Comparative 15 | KP-06 | 71.0-74.0 | 5-7 |
| Comparative 16 | AL-06 | 91.0-94.0 | 6.2-7.0 |
| Comparative 17 | NL-05 | ∃98.5 | 4.6-6.0 |

*Viscosity data for a 4% aqueous solution at 20° C. was obtained from the manufacturer.

The above elements were evaluated for 60° gloss, dry time, image quality, and coating quality as described in Example 1. The following results in Table X were obtained:

TABLE X

| Element | 60° Gloss (%) | Dry Time (sec.) | Coalescence | Bleed | Coating Quality |
|---|---|---|---|---|---|
| 21 | 49 | 20 | Good | Good | Good |
| 22 | 48 | 25 | Good | Good | Good |
| 23 | 49 | 25 | Good | Good | Good |
| 24 | 47 | 25 | Good | Good | Good |
| Comparative 13 | 45 | 30 | Fair | Fair | Good |
| Comparative 14 | 40 | 50 | Fair | Fair | Good |
| Comparative 15 | 5 | 20 | Fair | Fair | Poor |
| Comparative 16 | 31 | 25 | Fair | Fair | Good |
| Comparative 17 | 3 | 20 | Good | Good | Good |

The above results show that high gloss, fast dry time, and good image quality are observed with the recording elements of the invention as compared to the comparative recording elements.

The invention has been described in detail with particular reference to certain preferred embodiments thereof, but it will be understood that variations 15 and modifications can be effected within the spirit and scope of the invention.

What is claimed is:

1. A porous image-recording element comprising a support and an image-receiving layer, wherein said imaging receiving layer comprises anionic colloidal silica particles, hydrophilic polymeric binder, and fluorosurfactant, wherein said binder is present in an amount of between 2% and 15% by weight of said image-receiving layer, said image-recording element has a 60-degree gloss of greater than 25, and a dry time of less than 1 minute, wherein said anionic colloidal silica particles have a median diameter of between 80 and 200 nm, wherein at least 80% of said anionic colloidal silica particles have a diameter of within 35% smaller or larger than the median diameter of said anionic colloidal silica particles, wherein the counter ions for said anionic colloidal silica particles consist essentially of sodium, potassium, or ammonium ions, wherein said hydrophilic polymeric binder is poly(vinyl alcohol) having a percent hydrolysis of 77 to 90 and a viscosity for a 4% aqueous solution at 20° C. of 2.5 to 12 cps, wherein said fluorosurfactant is selected from at least one member of the group consisting of:

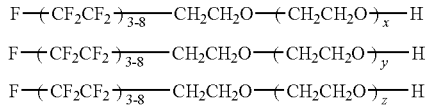

wherein x<y<z and x, y, and z are between 0 and 25 and wherein the distribution of the perfluoroethylene units in the perfluorinated portion of the three surfactants is different; and wherein the surface pH of said image-receiving layer moistened with water is between 8 and 10.

2. The image-recording element of claim 1 wherein the counterion for said anionic colloidal silica particles comprises potassium.

3. The image-recording element of claim 1 wherein said fluorosurfactant comprises between 0.05% and 3% of said image-receiving layer by weight.

4. The image-recording element of claim 1 wherein said image-receiving layer further comprises a latex polymer having a glass transition temperature of less than 30° C.

5. The image-recording element of claim 4 wherein said latex polymer is present in an amount of between 4% and 15% by weight of said image-receiving layer.

6. The image-recording element of claim 1 wherein said image-receiving layer further comprises a hardener.

7. The image-recording element of claim 1 wherein said image-receiving layer comprises borax; boric acid or its salts; 1,4-dioxane-2,3-diol; glyoxal; or bis(vinylsulfonyl)methane as a hardener.

8. The image-recording element of claim 1 wherein said support is nonporous and said image-receiving layer has a total coverage 35 and 65 g/m$^2$.

9. The image-recording element of claim 1 wherein said support is porous and said image-receiving layer has a total coverage of between 4 and 30 g/m$^2$.

10. The image-recording element of claim 1 wherein said support is porous and said image-receiving layer has a total coverage of between 6 and 20 g/m$^2$.

11. The image-recording element of claim 1 wherein an ink-absorbing layer is present between said support and said image-receiving layer.

12. The image-recording element of claim 11 wherein said ink-absorbing layer is porous, and said image-receiving layer has a total coverage of between 4 and 30 g/m$^2$.

13. The image-recording element of claim 11 wherein said ink-absorbing layer is porous, and said image-receiving layer has a total coverage of between 6 and 20 g/m$^2$.

14. The image-recording element of claim 1 wherein said image-recording element comprises an inkjet image-recording element.

* * * * *